United States Patent [19]

Baird, Jr.

[11] 4,087,349

[45] May 2, 1978

[54] HYDROCONVERSION AND DESULFURIZATION PROCESS

[75] Inventor: William C. Baird, Jr., Baton Rouge, La.

[73] Assignee: Exxon Research & Engineering Co., Linden, N.J.

[21] Appl. No.: 810,303

[22] Filed: Jun. 27, 1977

[51] Int. Cl.[2] ..... C10G 13/06; B01J 27/04

[52] U.S. Cl. ..... 208/108; 208/213; 208/230; 208/253; 423/641; 423/646

[58] Field of Search ..... 208/108, 107–112, 208/213, 230, 253; 252/439, 476

[56] References Cited

U.S. PATENT DOCUMENTS

| | | | |
|---|---|---|---|
| 3,598,535 | 8/1971 | Wennerberg | 208/230 X |
| 3,761,529 | 9/1973 | Drahoslav et al. | 260/643 A |
| 3,785,965 | 1/1974 | Welty | 208/230 X |
| 3,974,062 | 8/1976 | Owen et al. | 208/74 |
| 3,974,063 | 8/1976 | Owen et al. | 208/120 |
| 4,002,557 | 1/1977 | Owen et al. | 208/120 |
| 4,003,823 | 1/1977 | Baird et al. | 208/108 |
| 4,003,824 | 1/1977 | Baird et al. | 208/108 |

*Primary Examiner*—Delbert E. Gantz
*Assistant Examiner*—G. E. Schmitkons
*Attorney, Agent, or Firm*—Marthe L. Gibbons

[57] ABSTRACT

Sulfur-containing heavy hydrocarbonaceous oil feeds are simultaneously hydroconverted and desulfurized by reaction of the feed with an alkali metal alkoxide in the presence of added hydrogen at elevated temperatures.

9 Claims, 1 Drawing Figure

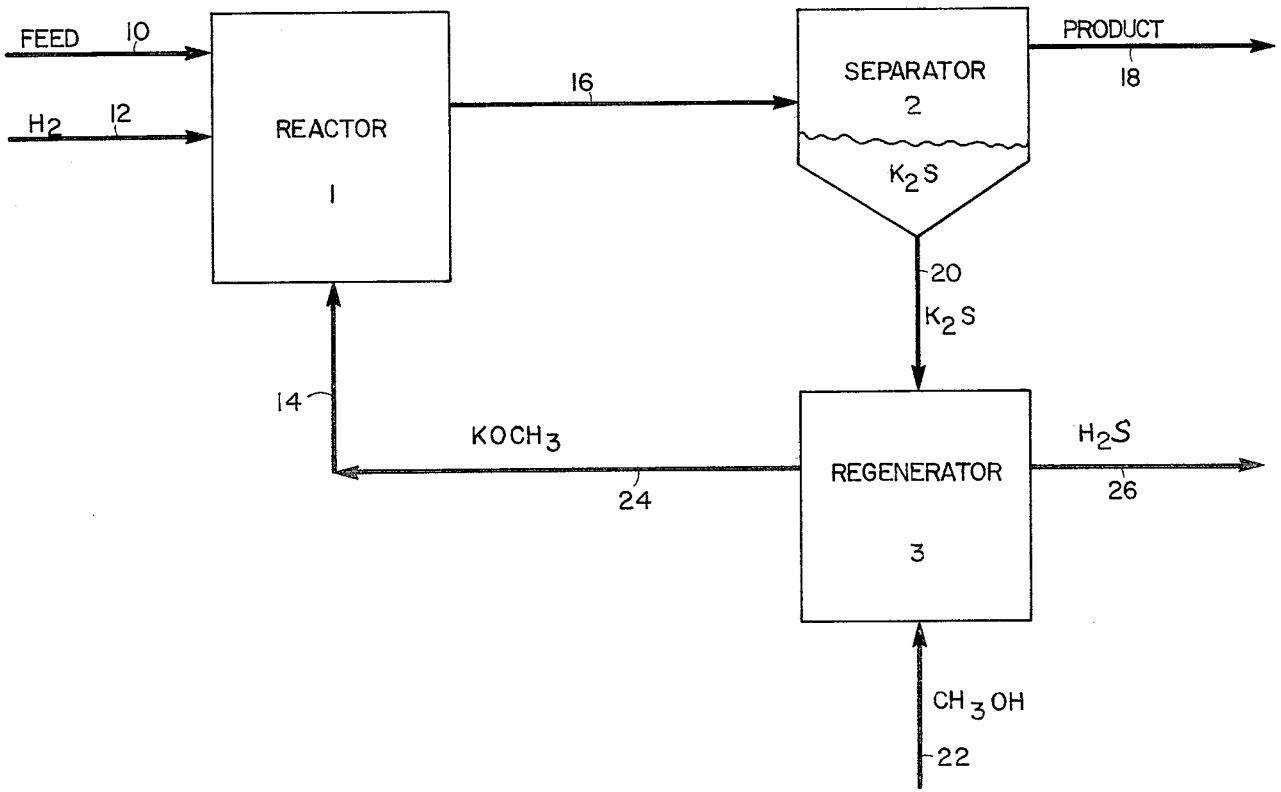
FEED
10
H2
12
REACTOR
1
16
SEPARATOR
2
K2S
PRODUCT
18
20
K2S
REGENERATOR
3
H2S
26
CH3OH
22
24
KOCH3
14

HYDROCONVERSION AND DESULFURIZATION PROCESS

BACKGROUND OF THE INVENTION

1. Field of the Invention

The present invention relates to a process for the simultaneous hydroconversion and desulfurization of sulfur-containing heavy hydrocarbonaceous oils by reaction with an alkali metal alkoxide in the presence of added hydrogen.

2. Description of the Prior Art

It is known to use various alkali metal compounds for the desulfurization and hydroconversion of sulfur-containing heavy hydrocarbonaceous oils, see for example, U.S. Pat. Nos. 3,976,559; 4,017,381; 4,003,824; 4,007,111; 4,007,109 and 4,003,823.

It has now been found that reaction of a sulfur-containing oil feed with an alkali metal alkoxide in the presence of added hydrogen will provide advantages that will become apparent in the ensuing description.

SUMMARY OF THE INVENTION

In accordance with the invention there is provided a process for simultaneously hydroconverting and desulfurizing a sulfur-containing heavy hydrocarbonaceous oil feed, which comprises reacting said oil feed with an alkali metal alkoxide derived from a $C_1$ to $C_4$ aliphatic monohydroxy saturated alcohol, in the presence of added hydrogen at hydroconversion and desulfurization conditions including an elevated temperature.

BRIEF DESCRIPTION OF THE DRAWING

The FIGURE is a schematic flow plan of one embodiment of the invention.

DETAILED DESCRIPTION OF THE INVENTION

A sulfur-containing heavy hydrocarbonaceous oil is reacted with an alkali metal alkoxide in the presence of added hydrogen at an elevated temperature. The alkali metal alkoxide is converted to the corresponding alkali metal sulfide or hydrosulfide by reaction with the sulfur of the feed. The oil feed is simultaneously hydroconverted and desulfurized to an oil product having a reduced content of sulfur and metals and a reduced Conradson carbon residue. The alkoxide may be regenerated from the by-products by reaction with an alcohol as described by Thomas and Rule, J. Chem. Soc. 103, 871.

The term "hydroconversion" is used herein to designate a process conducted in the presence of hydrogen in which at least a portion of the heavy constitutents of the hydrocarbonaceous oil is converted to lower boiling hydrocarbon products.

HEAVY HYDROCARBON FEEDSTOCKS

The heavy hydrocarbon feedstocks utilized in the present invention comprise hydrocarbons boiling above 650° F., at atmospheric pressure, which contain substantial quantities of materials boiling above 1000° F. The process is particularly suited for treating sulfur- and asphaltene-containing hydrocarbon oils containing greater than 100 ppm nickel and vanadium contaminants. Suitable feeds include heavy crude mineral oils and residual petroleum oil fractions, such as fractions produced by atmospheric and vacuum distillation of crude oil. Such residual oils usually contain large amounts of sulfur and metallic contaminants, such as nickel and vanadium. Total metal content of such oils may range up to 2000 weight parts per million or more, and the sulfur content may range up to 8 weight percent or more. The Conradson carbon residue of these heavy hydrocarbon feeds will generally range from about 5 to about 50 weight percent (as to Conradson carbon, see ASTM test D-1890-65). The preferred process feedstock is a petroleum residuum obtained from distillation or other treating or separation processes. Other suitable feedstock include heavy hydrocarbons recovered from tar sands, synthetic crude oils recovered from oil shales, heavy oils produced from the liquefaction of coal, etc.

The hydrocarbon feeds will generally contain at least 10 percent of material boiling above 1000° F. at atmospheric pressure.

THE ALKALI METAL ALKOXIDE

Suitable alkali metal alkoxide reagents for use in the process of the present invention are alkoxides of the Group IA metals including lithium, sodium, potassium, rubidium and cesium. The alkali metal alkoxides are derived from lower monohydroxy aliphatic saturated alcohols, that is, $C_1$ to $C_4$ saturated alcohols which may be straight chain as well as branched chain. By way of example, suitable alcohols from which the alkali metal alkoxides are derived are methanol, ethanol, 1-propanol, isopropyl alcohol, 1-butanol, 2-butanol, isobutyl alcohol and tertiary butyl alcohol. Preferred alkoxides are lithium methoxide, lithium ethoxide, sodium methoxide, sodium isopropoxide, potassium methoxide, potassium ethoxide and potassium tertiary butoxide. Particularly preferred is potassium methoxide.

The amount of metal alkoxide used will vary depending on the desired level of hydroconversion and desulfurization. Suitable amounts include from about 1 to about 50 weight percent metal alkoxide based on the oil feed, preferably from about 10 to about 30 weight percent alkali metal alkoxide based on the oil feed.

The hydrogen added to the reaction zone may be substantially pure hydrogen, although it would usually be a hydrogen stream containing some other gaseous contaminants, for example, the hydrogen-containing effluent produced in a reforming process.

OPERATING CONDITIONS

Suitable hydroconversion and desulfurization conditions are as follows:

| | BROAD RANGE | PREFERRED RANGE |
|---|---|---|
| Temperatures, ° F. | 500–1500° F. | 500–1000° F. |
| Hydrogen partial pressure, psig | 500–5000 psig | 500–3000 psig |
| Oil Space Velocity, V/V/Hr. | 0.1–10 | 0.1–4 |

The hydroconversion process can be conducted as a batch or as a continuous operation. The reaction may be conducted as a slurry process, a fixed bed process, a fluidized bed process or an ebullating bed process.

DESCRIPTION OF THE PREFERRED EMBODIMENT

The preferred embodiment will be described with reference to the accompanying FIGURE.

Referring to the FIGURE, a sulfur-containing hydrocarbonaceous oil feed is introduced via line 10 into a hydroconversion and desulfurization zone 1. Hydrogen is introduced into zone 1 via line 12. Potassium methoxide ($KOCH_3$) is introduced into zone 1 via line 14. Hydroconversion zone 1 is maintained at a temperature of about 820° F. and a hydrogen partial pressure of about 2000 psig.

After the desired degrees of desulfurization and hydroconversion have been attained, for example, after a residence time of about 60 minutes, the hydroconverted oil comprising potassium sulfide which was formed during the hydroconversion reaction is removed via line 16 and passed to separation zone 2 in which the potassium sulfide is separated from the hydroconverted oil by conventional means such as settling. The hydroconverted and desulfurized oil product is recovered from separation zone 2 by line 18. Potassium sulfide is removed from separation zone 2 via line 20 and passed to a regeneration zone 3. Methyl alcohol via line 22 is introduced into regeneration zone 3 to react with the potassium sulfide and form potassium methoxide and hydrogen sulfide. The regeneration zone is operated at a temperature of about 1000° F. and at a pressure of about 15 to 500 psig. The potassium methoxide powder is removed from regeneration zone 3 via line 24 and returned to the hydroconversion zone 1 via line 14. Hydrogen sulfide is removed from regeneration zone 3 via line 26, and if desired, sent for recovery as elemental sulfur by conventional means.

The following example is presented to illustrate the invention.

EXAMPLE

A Safanyia atmospheric residuum oil feed was reacted with various alkali metal alkoxides in batch runs at a temperature of 820° F., a hydrogen partial pressure of 1700 psig for 1 hour. Inspection of the oil feed used in the example is shown in Table I.

The results of these runs are summarized in Table II.

TABLE I

| FEEDSTOCK INSPECTION | |
|---|---|
| Feed Designation | Safanyia |
| 1050−, Vol. % | 59 |
| API Gravity | 14.4 |
| Sulfur, Wt. % | 4.0 |
| Nitrogen, Wt. % | 0.26 |
| Carbon, Wt. % | 84.42 |
| Hydrogen, Wt. % | 11.14 |
| Oxygen, Wt. % | 0.28 |
| Conradson Carbon, Wt. % | 12.1 |
| Asphaltene, Wt. % | 13.0 |
| Metals, ppm | |
| Ni | 20 |
| V | 77 101 |
| Fe | 4 |
| Viscosity | |
| VSF 122° F. | 235 |
| 144° F. | 130 |
| Pour Point, ° F. | 33 |
| Naphtha Insolubles, Wt. % | 7 |
| R.I. 67° C. | |

TABLE I-continued

| FEEDSTOCK INSPECTION | |
|---|---|
| Feed Designation | Safanyia |
| Flash Point, ° F. | 318 |

TABLE II

| Reagent, | $NaOCH_3$ | $KOCH_3$ | $KOC(CH_3)_3$ |
|---|---|---|---|
| Wt. % on Feed | 14.8 | 17.3 | 28.0 |
| $C_5^-$ Gas, Wt. % | 8.0 | 3.7 | 9.5 |
| Coke, Wt. % | 6.2 | 1.2 | 5.4 |
| $C_5^+$ Liquid Inspections | | | |
| Sulfur, Wt. % | 3.2 | 1.3 | 2.0 |
| Con. Carbon, Wt. % | 10.8 | 3.8 | 7.5 |
| Ni/V/Fe, ppm | 32 | 11 | 1 |
| API Gravity | 20.3 | 28.9 | 29.8 |
| 1050° F., Vol. % | — | 89.9 | — |
| Desulfurization, % | 30 | 68 | 57 |
| Con. Carbon Loss, % | 23 | 70 | 48 |
| Demetallization, % | 73 | 90 | ~100 |
| 1050° F.$^+$ Conversion, % | — | 75 | — |

What is claimed is:

1. A process for simultaneously hydroconverting and desulfurizing a sulfur-containing heavy hydrocarbonaceous oil feed, which comprises reacting said oil with an alkali metal alkoxide derived from a $C_1$ to $C_4$ aliphatic monohydroxy saturated alcohol, in the presence of added hydrogen at hydroconversion and desulfurization conditions including an elevated temperature, and recovering a hydroconverted oil.

2. The process of claim 1 wherein said alkali metal alkoxide is selected from the group consisting of lithium methoxide, lithium ethoxide, sodium methoxide, sodium isopropoxide, potassium methoxide, potassium ethoxide and potassium tertiary butoxide.

3. The process of claim 1 wherein said alkali metal alkoxide is potassium methoxide.

4. The process of claim 1 wherein said hydroconversion and desulfurization conditions include a temperature in the range of about 500 to about 1500° F. and a hydrogen partial pressure ranging from about 500 to about 5000 psig.

5. The process of claim 1 wherein said hydroconversion and desulfurization conditions include a temperature ranging from about 500 to about 1000° F. and a hydrogen partial pressure ranging from about 500 to about 3000 psig.

6. The process of claim 1 wherein said alkali metal alkoxide is present in an amount ranging from about 1 to about 50 weight percent based on said oil feed.

7. The process of claim 1 wherein said alkali metal alkoxide is present in an amount ranging from about 10 to about 30 weight percent based on said oil feed.

8. The process of claim 1 wherein said oil feed is an asphaltene-containing oil.

9. A process for the simultaneous hydroconversion and desulfurization of a sulfur-containing hydrocarbonaceous oil feed which comprises: reacting said oil feed with potassium methoxide in the presence of added hydrogen at a temperature ranging from about 500 to about 1500° F. and a hydrogen partial pressure ranging from about 500 to about 3000 psig for a time sufficient to reduce the sulfur content of said feed and to convert at least a portion of such feed to lower boiling hydrocarbon products.

* * * * *